US006912882B1

(12) United States Patent
Alonso

(10) Patent No.: US 6,912,882 B1
(45) Date of Patent: Jul. 5, 2005

(54) DOOR LOCKING SYSTEM

(76) Inventor: Atilano Alonso, 8018 Paddock St., Tampa, FL (US) 33614

( * ) Notice: Subject to any disclaimer, the term of this patent is extended or adjusted under 35 U.S.C. 154(b) by 0 days.

(21) Appl. No.: 10/688,524

(22) Filed: Oct. 17, 2003

Related U.S. Application Data

(63) Continuation-in-part of application No. 10/074,929, filed on Feb. 12, 2002, now abandoned.

(51) Int. Cl.[7] ..... E05B 13/00

(52) U.S. Cl. ..... 70/472; 70/149; 70/189; 70/223; 292/142; 292/150

(58) Field of Search ..... 70/419, 422, 472, 70/149, 188–190, 223, 224; 292/142, 150, 292/DIG. 51

(56) References Cited

U.S. PATENT DOCUMENTS

| | | | | | |
|---|---|---|---|---|---|
| 353,492 | A | * | 11/1886 | Kirwan | 292/359 |
| 528,269 | A | * | 10/1894 | Bettys | 292/150 |
| 754,280 | A | * | 3/1904 | Caswell | 292/170 |
| 1,010,992 | A | * | 12/1911 | Weathers | 70/134 |
| 1,125,791 | A | * | 1/1915 | Aston | 70/134 |
| 1,272,915 | A | * | 7/1918 | Cleaver | 70/107 |
| 1,374,393 | A | * | 4/1921 | Rorabeck | 70/107 |
| 1,378,622 | A | * | 5/1921 | Sarbij | 292/142 |
| 1,451,265 | A | * | 4/1923 | Landing | 70/107 |
| 1,956,388 | A | * | 4/1934 | Loeser | 70/416 |
| 3,785,188 | A | * | 1/1974 | Drathschmidt | 70/276 |
| 3,792,885 | A | * | 2/1974 | Giardina et al. | 292/39 |
| 3,928,993 | A | * | 12/1975 | Epstein | 70/419 |
| 4,047,408 | A | * | 9/1977 | Johns et al. | 70/129 |
| 4,438,962 | A | * | 3/1984 | Soloviff et al. | 292/144 |
| 4,745,785 | A | * | 5/1988 | Uebersax | 70/279.1 |

FOREIGN PATENT DOCUMENTS

| | | | | |
|---|---|---|---|---|
| AU | 150016 | * | 2/1953 | 292/142 |
| DE | 47941 | * | 8/1889 | 70/209 |
| GB | 2137688 | * | 10/1984 | 292/142 |
| WO | WO84/02157 | * | 6/1984 | 70/209 |

* cited by examiner

*Primary Examiner*—Lloyd A. Gall
(74) *Attorney, Agent, or Firm*—Edward P. Dutkiewicz

(57) ABSTRACT

A door locking system for precluding the picking of a lock comprises a door. The door has an outside, an inside and a facing surface. A bolt is mounted in the door. The bolt is adapted to slide between an unlocked orientation and a locked orientation. The bolt is formed to include a linear surface with gear teeth constituting a rack. A handle housing is mounted on the door. The handle housing has a handle. The handle has a handle shaft rotatable with the handle and coaxial therewith. A pinion gear is coupled to the handle shaft and formed with peripheral gear teeth in meshing engagement with the teeth of the rack. An operator controlled locking member is provided. The locking member is slidably coupled with respect to the handle shaft on the inside of the door to optionally lock and unlock the door and to preclude picking the lock.

6 Claims, 8 Drawing Sheets

FIG 1
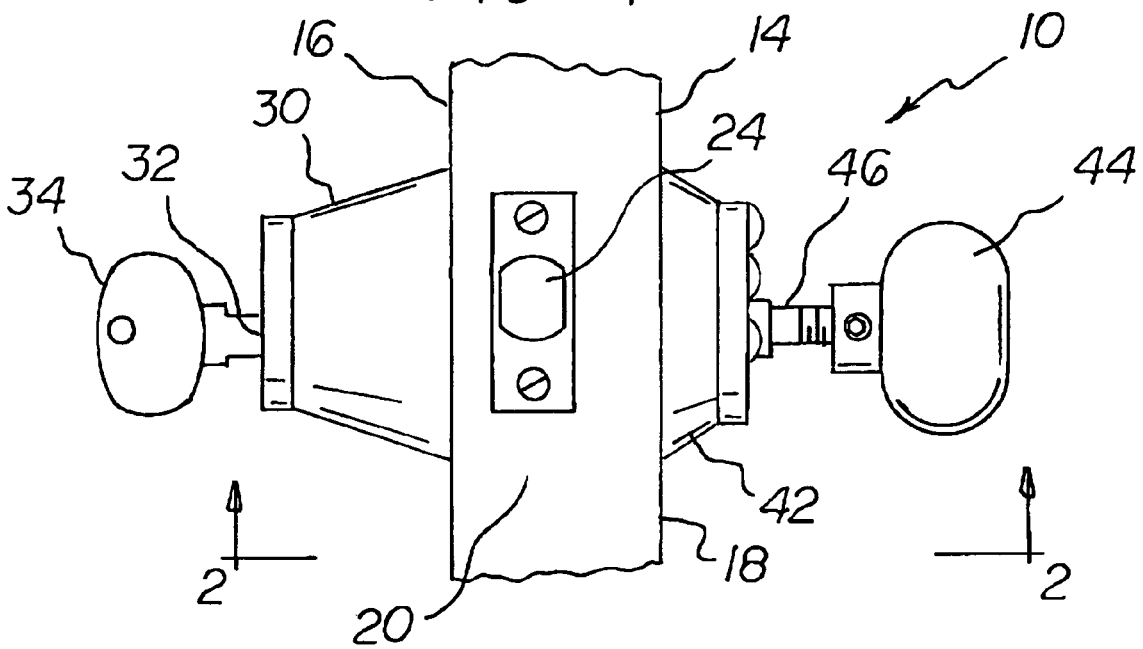
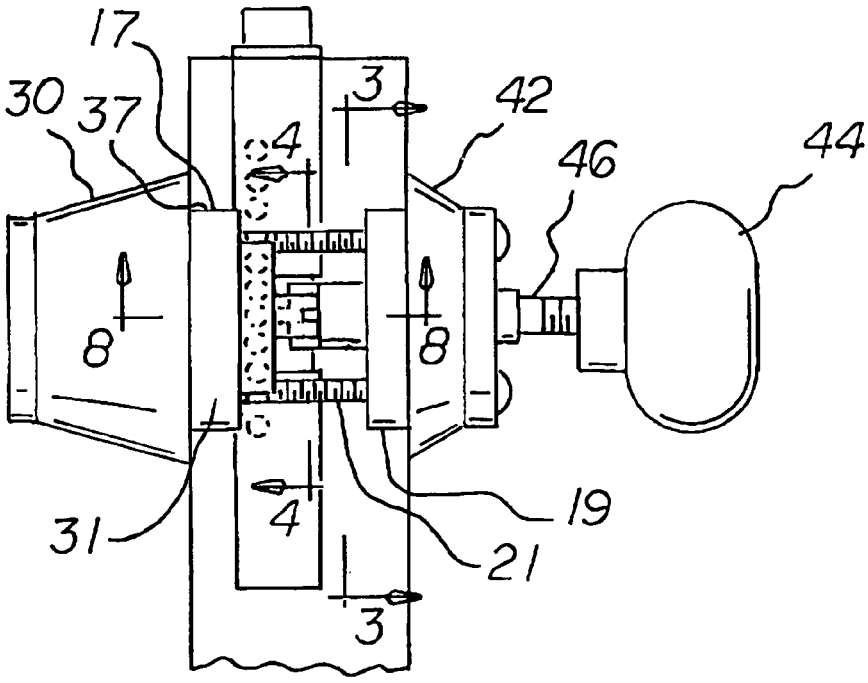
FIG 2

FIG 3
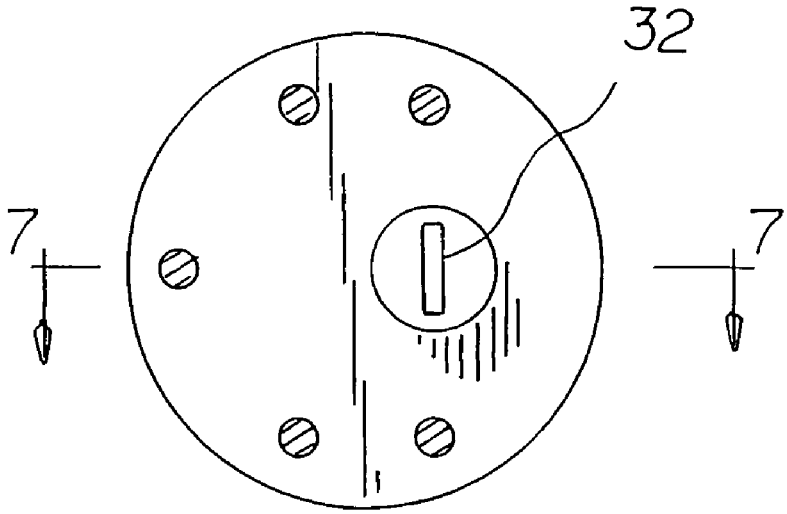
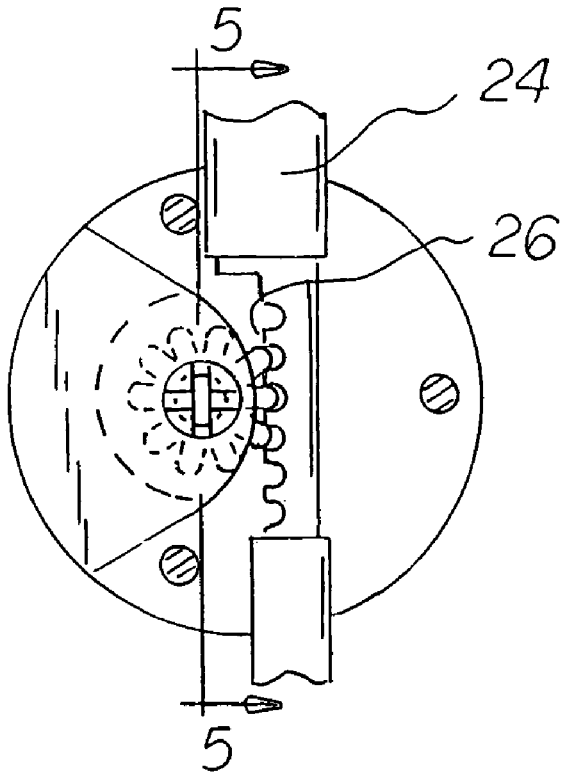
FIG 4

FIG 7
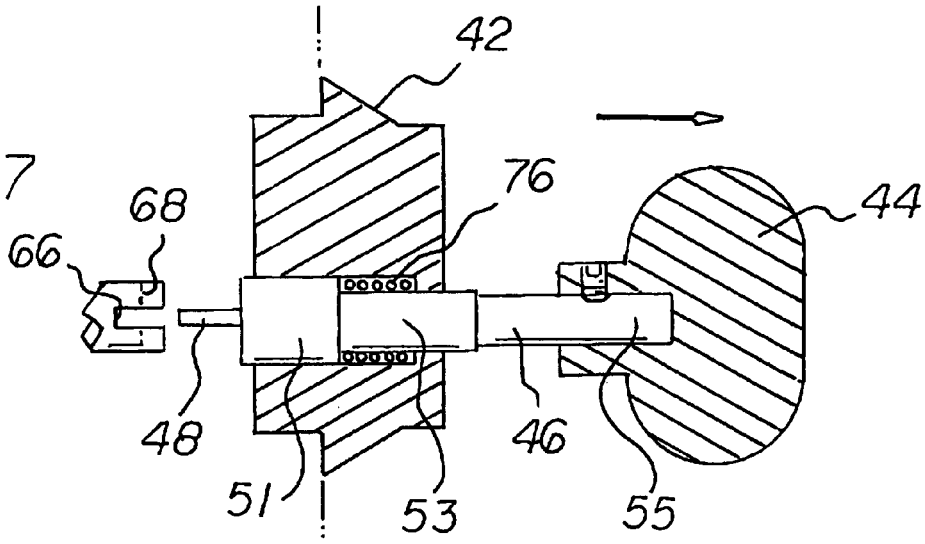
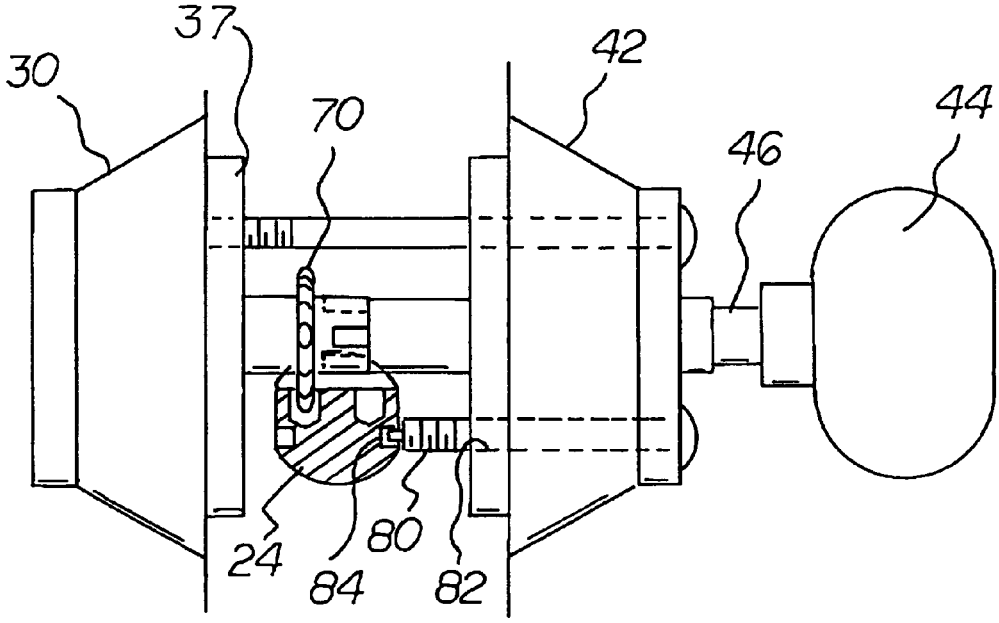
FIG 8

DOOR LOCKING SYSTEM

RELATED APPLICATION

The present application is a Continuation-in-Part Application of Ser. No. 10/074,929, filed on Feb. 12, 2002, now abandoned.

BACKGROUND OF THE INVENTION

1. Field of the Invention

The present invention relates to a door locking system and more particularly pertains to precluding the picking of a lock when the interior handle is positioned in a locking orientation.

2. Description of the Prior Art

The use of locks of known designs and configurations is known in the prior art. More specifically, locks of known designs and configurations previously devised and utilized for the purpose of preventing lock picking through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,006,816 to Wolfe discloses a lock. U.S. Pat. No. 1,378,622 to Sarbij discloses a door lock. U.S. Pat. No. 1,520,509 to Rancour discloses a burglarproof lock. U.S. Pat. No. 2,028,806 to Michel discloses electric control lock. U.S. Pat. No. 4,248,068 to Esser et al. discloses deadlocking mechanism. U.S. Pat. No. 4,502,716 to Yu discloses two-shift lock-tongue drive unit. U.S. Pat. No. 4,633,688 to Beudat et al. discloses lock device. U.S. Pat. No. 4,784,415 to Malaval discloses locking and unlocking device. U.S. Pat. No. 5,301,989 to Dallmann et al. discloses tilt lock for double-hung windows. French Patent No. 511.951 to Muller discloses a lock. French Patent No. 618.732 to Gachon discloses a lock. German Patent No. 472651 to Stanzmetall discloses a lock. Lastly, Australia Patent No. 28021/77 to Resoagli discloses a lock.

While these devices fulfill their respective, particular objectives and requirements, the aforementioned patents do not describe a door locking system that allows precluding the picking of a lock when the interior handle is positioned in a locking orientation.

In this respect, the door locking system according to the present invention substantially departs from the conventional concepts and designs of the prior art, and in doing so provides an apparatus primarily developed for the purpose of precluding the picking of a lock when the interior handle is positioned in a locking orientation.

Therefore, it can be appreciated that there exists a continuing need for a new and improved door locking system which can be used for precluding the picking of a lock when the interior handle is positioned in a locking orientation. In this regard, the present invention substantially fulfills this need.

SUMMARY OF THE INVENTION

In view of the foregoing disadvantages inherent in the known types of locks of known designs and configurations now present in the prior art, the present invention provides an improved door locking system. As such, the general purpose of the present invention, which will be described subsequently in greater detail, is to provide a new and improved door locking system and method which has all the advantages of the prior art and none of the disadvantages.

To attain this, the present invention essentially comprises a door locking system for providing the user with a pick-proof lock. The locking system comprising several components in combination. First provided is a structure having a door jamb to receive a door therein. The door jamb has a recess therein. Next provided is a door. The door has an outside surface with a lock hole of a first diameter and an inside surface with a lock hole of a first diameter. The door has a passageway there through between the outside surface lock hole and the inside surface lock hole for the passageway of a locking mechanism. The door has an edge surface located between the outside surface and the inside surface. The edge is positionable against the door jamb in which the door is mounted. Next provided is a bolt receiving plate having a bolt aperture there through. The bolt hole is configured to receive and cooperate with the bolt aperture of the door jamb. The plate is configured to be mounted on a recipient door jamb. The bolt receiving plate has a plurality of screw mounting holes there in. Next provided is a lock having an internal lock housing and an external lock housing and a bolt operating mechanism there between. The external lock housing has a round tapered exterior configuration. The housing has an innermost portion and an outer portion. The innermost portion has a centrally located round tubular protrusion with a passageway there through and a round flat contacting surface. The protrusion is configured to be received by the lock hole in the outer surface of the door and to be contained there in. The round flat contacting surface of the inner portion is configured to abut the outside surface of the door. The external lock housing has an internal tumbler mechanism and a rotatable key receiving shaft located therein. The key shaft has an interior end facing the inside of the door and an exterior end. The key shaft has a centrally located rectilinear aperture running there through, within, and coaxial with the key shaft. The internal lock housing of the lock has a round tapered exterior configuration. The housing has an innermost portion and an outer portion. The innermost portion has a centrally located round tubular protrusion with a lock handle shaft passageway there through and a round flat contacting surface. The protrusion is configured to be received by the lock hole in the inner surface of the door and to be contained there in. The round flat contacting surface is configured to abut the inside surface of the door. The internal lock housing has a stepped rotating door handle shaft having a door end with a rectilinear recess and a handle end having a flattened handle receiving tip. The shaft has three exterior dimensions. The first dimension is located within the housing on the door end and the second dimension is located between the door end and handle end of the shaft. The third dimension is located on the handle end of the shaft. The first dimension is greater than the second dimension, and the second dimension is greater than the third dimension. The handle shaft is limitedly movable in an axial back and forth direction by a user. The handle shaft is also rotatable in a plane perpendicular to the axial movement of the shaft. The handle shaft is aligned with and contained within the lock handle shaft passageway. Next provided is a handle being coupled to the handle shaft. Next provided is a pinion subassembly. The pinion subassembly comprises an engagement plate, a biasing spring, a pinion gear, and a gear shield. The engagement plate has a flat stepped configuration with an outer end and a gear end and a spring portion there between. The outer end has a squared flat end having a fourth dimension with a downwardly projecting rectilinear tooth having a fifth dimension.

The spring portion has a spring nest there in, for receiving and holding a biasing spring therein. The biasing spring urges the plate in an outwardly direction toward the outer surface of the door. The gear end of the engagement plate has a downwardly projecting rectilinear tooth having a fifth dimension and a squared flat inner end. The pinion gear has an outer portion and an inner portion with a toothed portion there between. The pinion gear has a round hole having a fourth dimension there through. The outer portion of the pinion gear has a vertical slot sized to accommodate a fifth dimension cut there into, with the slot sized to engage the downwardly projecting rectilinear tooth of the gear end of the engagement plate. The inner portion of the pinion gear has two slots, each slot perpendicular to the other. One inner portion pinion gear slot is deeper than the other inner portion pinion gear slot. Both pinion gear slots have a fifth dimension. The subassembly gear shield has a round slot cut there into and the gear shield has a hole there through. The hole has a diameter the size of the fifth dimension. The shield has a plurality of screw holes there through and is coupled to the innermost portion of the external lock housing. Next provided is a bolt. The bolt comprises a shaft with a generally rounded cross sectional shape. The bolt has a flat slotted area having a plurality of pairs of gear engagement recesses there into. The gear engagement recesses are sized to receive and accommodate the toothed portion of the pinion gear. The bolt is slidably mounted in the door and configured to laterally slide between an unlocked orientation, with the bolt being totally within the door, and a locked orientation, wherein the bolt extends from the door edge and engages the bolt receiving plate in the door jamb. Lastly provided is a handle plate. The handle plate has a flat rectilinear configuration with a fifth dimension. The handle plate is sized to be accepted by and accommodated by, and slidable within, the rectilinear recess of the handle shaft of the internal lock housing. The handle plate has a protruding tooth, said tooth protruding toward, and coaxial with, the key shaft of the external lock housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door locking system which has all of the advantages of the prior art locks of known designs and configurations and none of the disadvantages.

It is another object of the present invention to provide a new and improved door locking system which may be easily and efficiently manufactured and marketed.

It is further an object of the present invention to provide a new and improved door locking system which is of durable and reliable constructions.

An even further object of the present invention is to provide a new and improved door locking system which is susceptible of a low cost of manufacture with regard to both materials and labor, and which accordingly is then susceptible of low prices of sale to the consuming public, thereby making such door locking system economically available to the buying public.

Even still another object of the present invention is to provide a door locking system for precluding the picking of a lock when the interior handle is positioned in a locking orientation.

Lastly, it is an object of the present invention to provide a new and improved door locking system for precluding the picking of a lock comprising a door. The door has an outside, an inside and a facing surface. A bolt is mounted in the door. The bolt is adapted to slide between an unlocked orientation and a locked orientation. The bolt is formed to include a linear surface with gear teeth constituting a rack. A handle housing is mounted on the door. The handle housing has a handle. The handle has a handle shaft rotatable with the handle and coaxial therewith. A pinion gear is coupled to the handle shaft and formed with peripheral gear teeth in meshing engagement with the teeth of the rack. An operator controlled locking member is provided. The locking member is slidably coupled with respect to the handle shaft on the inside of the door to optionally lock and unlock the door and to preclude picking the lock.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the locking system constructed in accordance with the principals of the present invention.

FIG. 2 is a cross-sectional view taken along line 2—2 of FIG. 1.

FIG. 3 is a cross-sectional view taken along line 3—3 of FIG. 2.

FIG. 4 is a cross-sectional view taken along line 4—4 of FIG. 2.

FIG. 7 is a cross-sectional view taken along line 7—7 of FIG. 3.

FIG. 8 is a cross-sectional view taken along line 8—8 of FIG. 2.

The same reference numerals refer to the same parts throughout the various Figures.

DESCRIPTION OF THE PREFERRED EMBODIMENT

Figure 6:
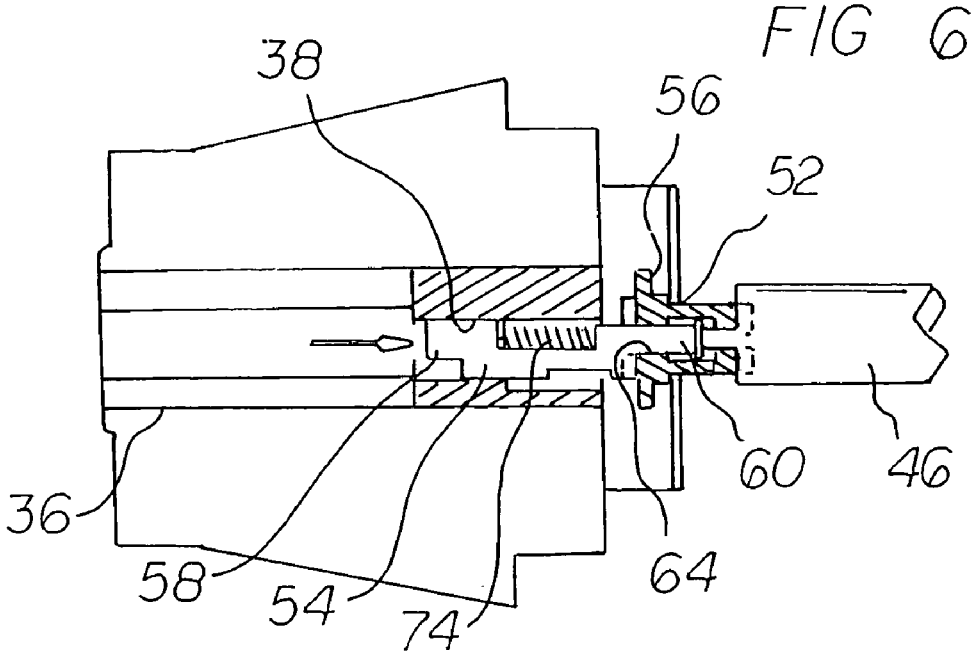
FIG. 6 is a cross-sectional view similar to FIG. 5 but showing the system in an alternate configuration.
Figure 5:
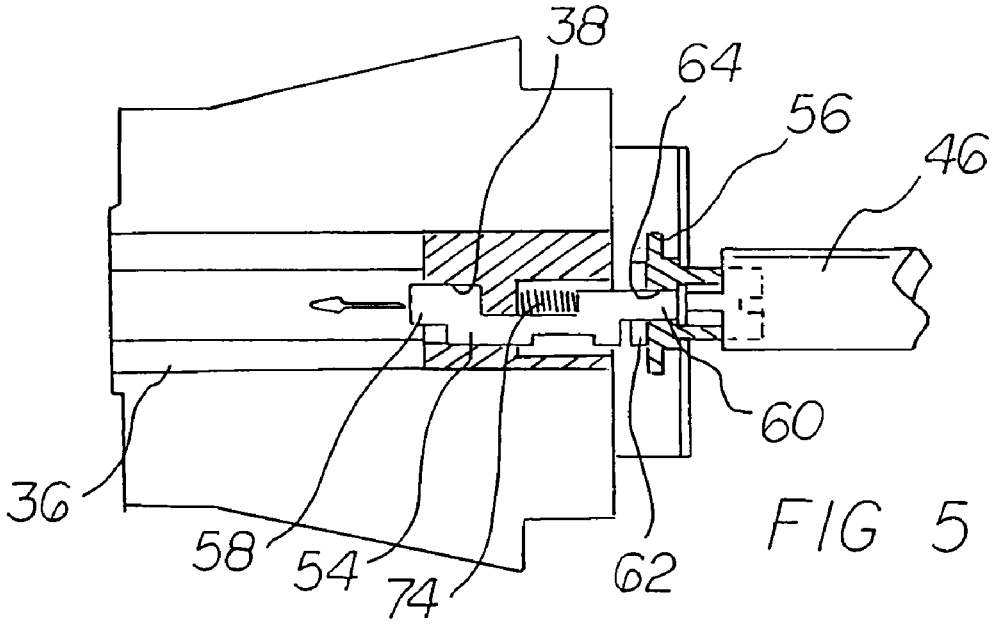
FIG. 5 is a cross-sectional view taken along line 5—5 of FIG. 4.

With reference now to the drawings, and in particular to FIG. 1 thereof, the preferred embodiment of the new and improved door locking system embodying the principles and concepts of the present invention and generally designated by the reference numeral 10 will be described.

The present invention, a locking system comprises several components in combination. It should be understood in one skilled in the art that the concepts disclosed herein can be applied in a variety of configurations without falling outside the scope of this disclosure.

First provided is a structure having a door jamb (not shown) to receive a door therein. The door jamb has a recess therein.

Next provided is a door. The door has an outside surface 16 with a lock hole 17 of a first diameter and an inside surface 14 with a lock hole 19 of a first diameter. The door has a passageway 21 there through between the outside surface lock hole and the inside surface lock hole for the passageway of a locking mechanism. The door has an edge 20 surface located between the outside surface and the inside surface. The edge is positionable against the door jamb in which the door is mounted.

Next provided is a bolt receiving plate 23 having a bolt aperture 25 there through. The bolt hole is configured to receive and cooperate with the bolt aperture of the door jamb. The plate is configured to be mounted on a recipient door jamb. The bolt receiving plate has a plurality of screw mounting holes there in.

In an alternate embodiment of the invention, the bolt receiving plate may have more than one bolt hole to allow the use of more than one bolt, being a secondary bolt 114 in any one lock configuration.

Next provided is a lock having an internal lock housing 42 and an external lock housing 30 and a bolt operating mechanism there between. The external lock housing has a round tapered exterior configuration. The housing has an innermost portion and an outer portion. The innermost portion has a centrally located round tubular protrusion 31 with a passageway there through and a round flat contacting surface 37. The protrusion is configured to be received by the lock hole in the outer surface of the door and to be contained there in. The round flat contacting surface 37 of the inner portion is configured to abut the outside surface of the door. The external lock housing has an internal tumbler mechanism (not shown) and a rotatable key receiving shaft (not shown) located therein. The key shaft has an interior end facing the inside of the door and an exterior end. The key shaft has a centrally located rectilinear aperture 32 running there through, within, and coaxial with the key shaft.

The internal lock housing of the lock has a round tapered exterior configuration. The housing has an innermost portion and an outer portion. The innermost portion has a centrally located round tubular protrusion 33 with a lock handle shaft passageway 35 there through and a round flat contacting surface. The protrusion is configured to be received by the lock hole in the inner surface of the door and to be contained there in. The round flat contacting surface is configured to abut the inside surface of the door.

The internal lock housing has a stepped rotating door handle 46 shaft having a door end 47 with a rectilinear recess 49 and a handle end having a flattened handle receiving tip. The shaft has three exterior dimensions. The first dimension 51 is located within the housing on the door end and the second dimension 53 is located between the door end and handle end of the shaft. The third dimension 55 is located on the handle end of the shaft. The first dimension is greater than the second dimension, and the second dimension is greater than the third dimension. The handle shaft is limitedly movable in an axial back and forth direction by a user. The handle shaft is also rotatable in a plane perpendicular to the axial movement of the shaft. The handle shaft is aligned with and contained within the lock handle shaft passageway.

In an alternate embodiment the handle shaft may have an associated spring 76 to bias the handle shaft in a position toward the outer surface of the door. This configuration would be employed when there are a plurality of slots on the inner end of the pinion gear. After operating the door lock mechanism, the user would pull inward on the handle, disengaging it from the pinion gear. The user would rotate the handle ninety degrees and then allow the handle to be biased toward the outer door surface. The ninety degree rotation would then engage the shallower of the two gear slots thereby preventing the protruding tooth from engaging the engagement plate and allowing the pinion gear to be rotated.

Figure 10:
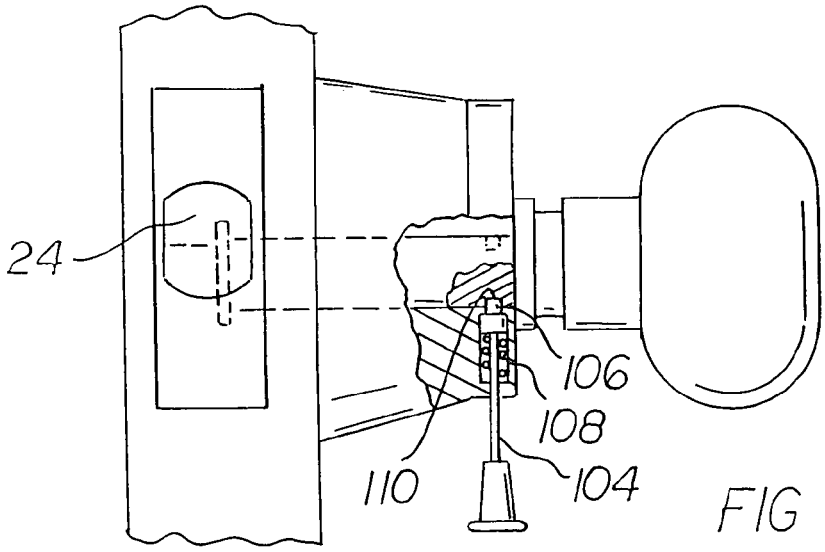
FIG. 10 is view similar to FIG. 9 but with additional parts shown in cross section.
Figure 9:
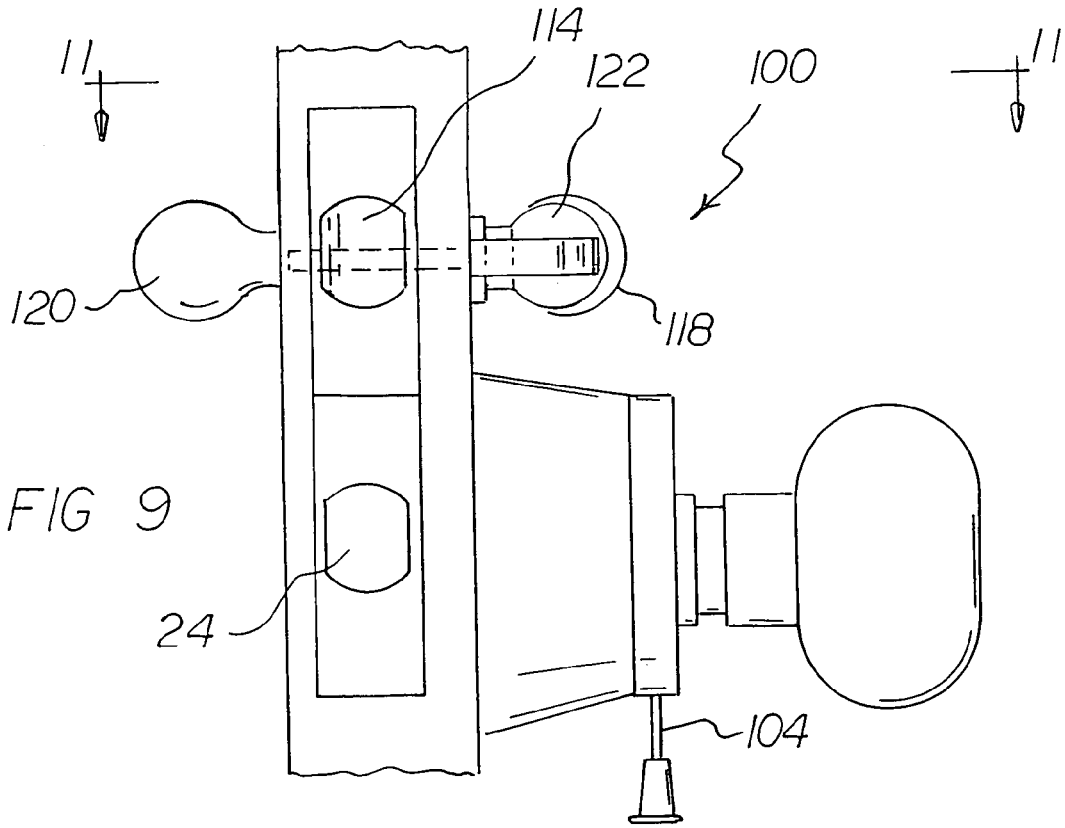
FIG. 9 is a side elevational view partly in cross section illustrating an alternate embodiment of the invention.
Figure 11:
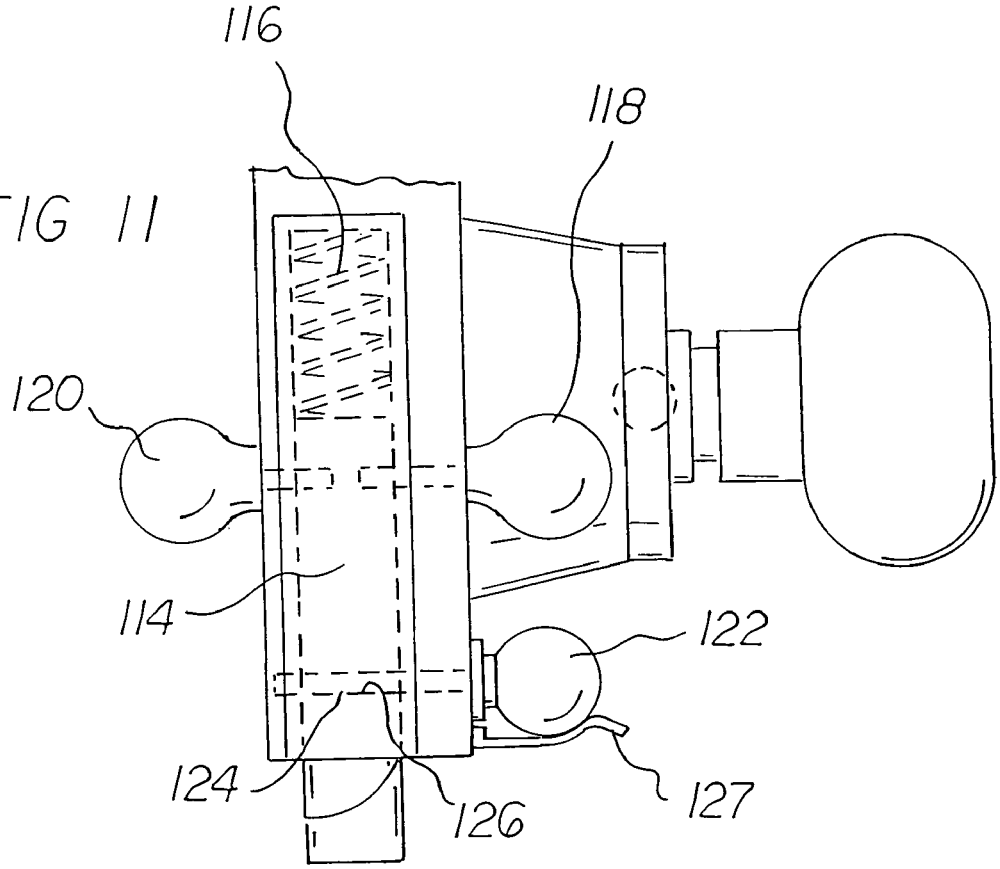
FIG. 11 is a cross-sectional view taken along line 11—11 of FIG. 9.
Figure 12:
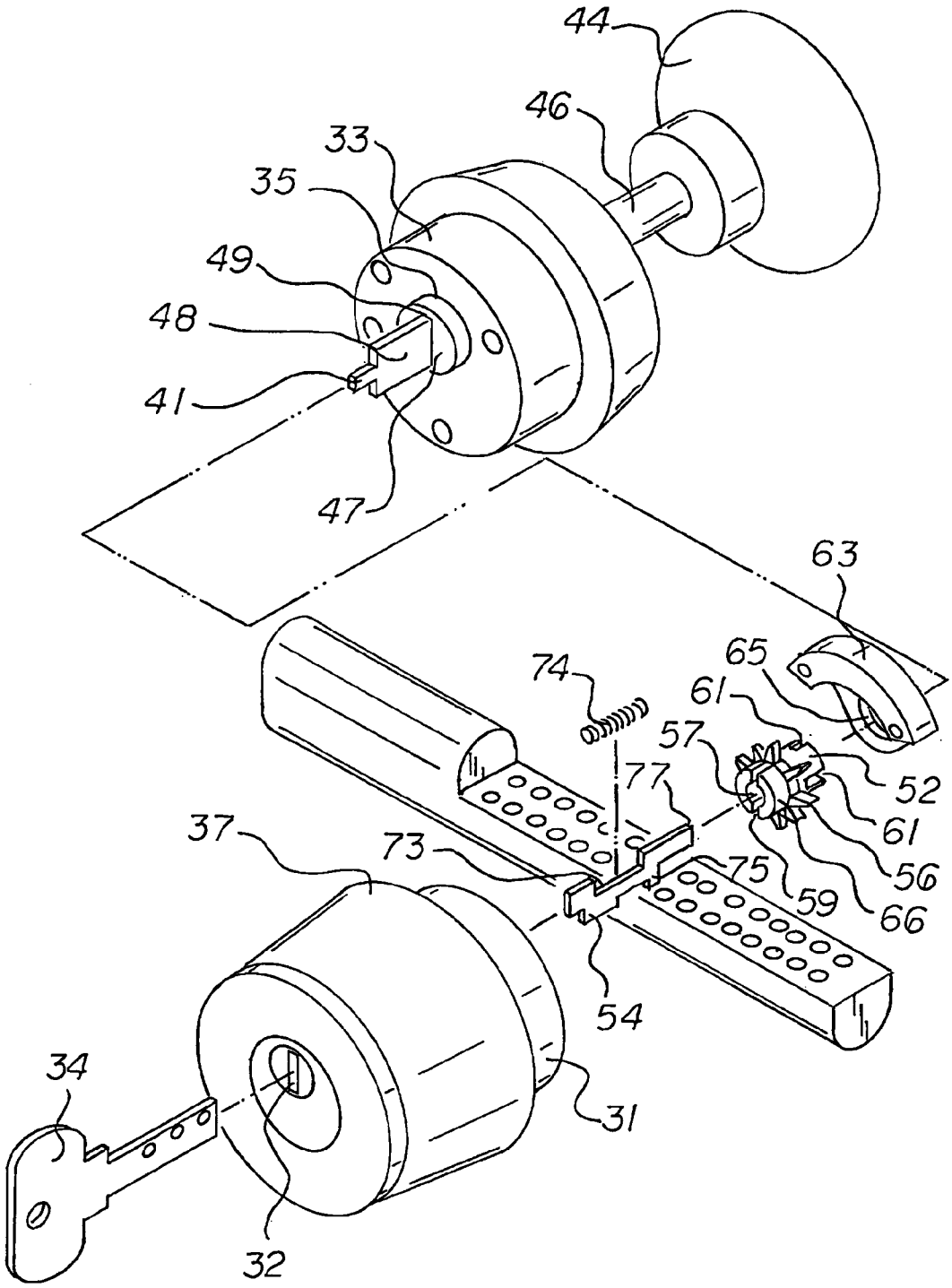
FIG. 12 is an exploded view of the invention demonstrating the interior components and their relation to each other.
Figure 13:
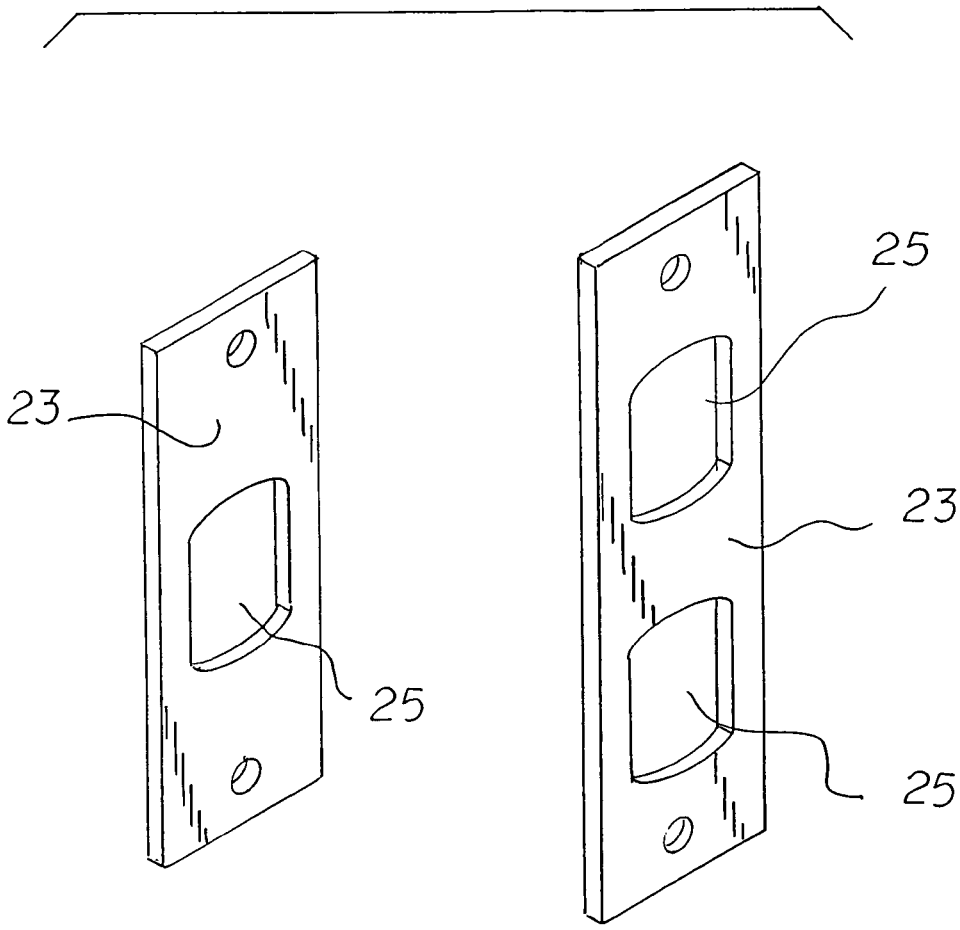
FIG. 13 is a perspective view of the bolt receiving plates of the present invention.

In an alternate embodiment as shown in FIG. 10, the handle shaft may have an associated stop-pin 104 to engage the handle and prevent rotation. The pin is coupled to the rotating door handle shaft 46. The door handle shaft having at least one detent 110 therein. The pin having a protuberance 106 to couple the pin to the handle shaft detent. In this configuration, there is a biasing spring 108 coupled to the pin.

Next provided is a handle 44 being coupled to the handle shaft. The handle may be coupled to the shaft by a set screw.

In an alternate embodiment the internal lock housing may also have an associated hand operated bolt subassembly 100 coupled thereto. The subassembly comprises a bolt 114, an outside bolt handle 120, an interior bolt handle 118, and bolt locking pin 122 having a bolt engaging portion 124 and a retention spring 127. The hand operated bolt subassembly allows a user to lock the door and then slide a hand operated bolt into the door jamb receiving plate. The bolt may be manually locked in place using a pin that passes through the bolt and prevents the bolt from being moved from the locked position until the locking pin is removed.

Next provided is a pinion subassembly. The pinion subassembly comprises an engagement plate, a biasing spring, a pinion gear, and a gear shield. The engagement plate 58 has a flat stepped configuration with an outer end and a gear end and a spring portion there between. The outer end has a squared flat end having a fourth dimension 38 with a downwardly projecting rectilinear tooth 54 having a fifth dimension. The spring portion has a spring nest 73 there in, for receiving and holding a biasing spring therein. The biasing spring 74 urges the plate in an outwardly direction toward the outer surface of the door. The gear end of the engagement plate has a downwardly projecting rectilinear tooth 75 having a fifth dimension and a squared flat inner end 77. The pinion gear has an outer portion 66 and an inner portion 52 with a toothed portion 56 there between. The pinion gear has a round hole having a fourth dimension 57 there through. The outer portion of the pinion gear has a vertical slot 59 sized to accommodate a fifth dimension cut there into, with the slot sized to engage the downwardly projecting rectilinear tooth of the gear end of the engagement plate. The inner portion of the pinion gear has two slots 61, each slot perpendicular to the other. One inner portion pinion gear slot is deeper than the other inner portion pinion gear slot. Both pinion gear slots have a fifth dimension.

The pinion subassembly functions in the following way. A user inserts his or her key into the key aperture. The passage of the key causes the key to directly push against the engagement plate. The key not only allows the tumblers to move, but the pushing of the key against the engagement plate causes the plate to move inwardly, against the bias of the nested spring. The engagement plate is located within the pinion gear. The advancement of the plate causes the downwardly projecting tooth 54 to engage the slot 59 in the pinion gear, allowing the gear to turn and move the bolt into a locked or unlocked position. When the key is removed, the engagement plate is once again biased toward the outside of the door and the tooth disengages from the slot of the gear, preventing the gear from moving the bolt. Without the proper key, the gear cannot be engaged and the bolt cannot be moved.

The subassembly gear shield 63 has a round slot cut there into and the gear shield has a hole 65 there through. The hole has a diameter the size of the fifth dimension. The shield has a plurality of screw holes there through and is coupled to the innermost portion of the external lock housing.

Next provided is a bolt 24. The bolt comprises a shaft with a generally rounded cross sectional shape. The bolt has a flat slotted area having a plurality of pairs of gear engagement recesses 26 there into. The rounded surfaces of the bolt may be smooth or may have a plurality of grooves 84. The grooves accommodate pin-tipped screws 80 which act to stabilize the bolt and to provide a track on which the bolt rides. The gear engagement recesses are sized to receive and accommodate the toothed portion of the pinion gear. The bolt is slidably mounted in the door and configured to laterally slide between an unlocked orientation, with the bolt being totally within the door, and a locked orientation, wherein the bolt extends from the door edge and engages the bolt receiving plate in the door jamb.

In an alternate embodiment the bolt may also have at least one bolt retaining pin hole 126 there through, to allow the manual pinning of a bolt in a locked position.

Next provided is a handle plate 48. The handle plate has a flat rectilinear configuration with a fifth dimension. The handle plate is sized to be accepted by and accommodated by, and slidable within, the rectilinear recess of the handle shaft of the internal lock housing. The handle plate has a protruding tooth 41, said tooth protruding toward, and coaxial with, the key shaft of the external lock housing.

Lastly provided is a key 34 that engages and actuates the tumblers of the lock.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door locking system comprising, in combination:

a door having an outside surface and an inside surface and a hole in the door to receive a lock;

a bolt receiving plate having a bolt aperture and a plurality of screw mounting holes there in;

a pinion gear having a plurality of slots;

a lock having an internal lock housing having a handle and handle shaft and an external lock housing, the lock having a bolt operating mechanism comprising an engagement plate and a spring and a pinion gear and a gear shield and a handle plate and a bolt there between said slots adapted to receive the engagement plate and handle plate.

2. The system as set forth in claim 1 and further including a handle plate biasing spring coupled to the internal housing and the handle plate.

3. The system as set forth in claim 1 wherein the lock has a set of associated tumblers and a keyhole there into.

4. The system as set forth in claim 1 further comprising:

the handle shaft having a radial recess there in;

the interior housing having a radially located and oriented locking member, the locking member being a radially oriented rod slidably mounted in the interior housing with a tip biased by a spring into contact with the handle shaft recess to be received by and mated with the handle shaft recess thereby preventing rotation or axial movement of the handle shaft.

5. The system as set forth in claim 1 further comprising:

the bolt receiving plate having a second bolt aperture there in;

the bolt having a hole therein;

a secondary bolt mounted in the door and configured to laterally slide between an unlocked orientation totally within the door and a locked orientation exterior of the door and extendable into the second bolt aperture in the bolt receiving plate, the secondary bolt having a spring biasing the secondary bolt to the locked orientation, the secondary bolt also having an interior knob for unlocking the secondary bolt from the inside and an exterior knob for unlocking the secondary bolt from the outside, the system also including a locking pin located on the interior surface of the door, the locking pin being slidable and perpendicular to the bolt, the locking pin engaging the hole in the bolt to prevent movement of the bolt.

6. A door locking system for providing the user with a pick-proof lock comprising, in combination:

a door having an outside surface with a lock hole of a first diameter and an inside surface with a lock hole of a first diameter, the door having a passageway there through between the outside surface lock hole and the inside surface lock hole for the passageway of a locking mechanism, the door having an edge surface located between the outside surface and the inside surface;

a bolt receiving plate having a bolt aperture there through, the bolt receiving plate having a plurality of screw mounting holes there in;

a lock having an internal lock housing and an external lock housing and a bolt operating mechanism there between, the external lock housing having a round tapered exterior configuration, the housing having an innermost portion and an outer portion, the innermost portion having a centrally located round tubular protrusion with a passageway there through and a round flat contacting surface, the protrusion being configured to be received by the lock hole in the outer surface of the door and to be contained there in, and the round flat contacting surface being configured to abut the outside surface of the door surface, the external lock housing having an internal tumbler mechanism and a rotatable key receiving shaft located therein, the key shaft having an interior end facing the inside of the door and an exterior end, the key shaft has a centrally located rectilinear aperture running there through, within, and coaxial with the key shaft, the internal lock housing of the lock having a round tapered exterior configuration, the housing having an innermost portion and an outer portion, the innermost portion having a centrally located round tubular protrusion with a lock handle shaft passageway there through and a round flat contacting surface, the protrusion being configured to be received by the lock hole in the inner surface of the door and to be contained there in, and the round flat contacting surface being configured to abut the inside surface of the door surface, the internal lock housing having a stepped rotating door handle shaft having a door end with a rectilinear recess and a handle end having a flattened handle receiving tip, the shaft having three exterior dimensions, a first dimension being located within the housing on the door end and a second dimension being between the door end and handle end of the shaft and the third dimension being located on the handle end of the shaft, with the first dimension being greater than the second dimension and the second dimension being greater than the third dimension, the handle shaft being limitedly movable in an axial back and forth direction by a user, the handle shaft being rotatable in a plane perpendicular to the axial movement of the shaft, the handle shaft being aligned with and contained within the lock handle shaft passageway;

a handle being coupled to the handle shaft;

a pinion subassembly having an engagement plate and a biasing spring and a pinion gear and a gear shield, the engagement plate having a flat stepped configuration with an outer end and a gear end and a spring portion there between, the outer end having a squared flat end having a fourth dimension with a downwardly projecting rectilinear tooth having a fifth dimension, the spring portion having a spring nest there in for receiving and holding a biasing spring therein, the biasing spring urging the plate in an outwardly direction toward the outer surface of the door, with the gear end having a downwardly projecting rectilinear tooth having a fifth dimension and a squared flat inner end, the pinion gear having an outer portion and an inner portion with a toothed portion there between, the pinion gear having a round hole having a fourth dimension there through, the outer portion of the pinion gear having a vertical slot sized to accommodate a fifth dimension cut there into with the slot sized to engage the downwardly projecting rectilinear tooth of the gear end of the engagement plate, the inner portion of the pinion gear having two slots each perpendicular to the other, with one inner portion pinion gear slot being deeper than the other inner portion pinion gear slot, with both slots having a fifth dimension, the subassembly gear shield having a hole there through, the hole having a diameter the size of the fifth dimension, the shield coupled to the innermost portion of the external lock housing;

a bolt comprising a shaft having a generally rounded cross sectional shape with a flat slotted area having a plurality of pairs of gear engagement recesses there into, the gear engagement recesses sized to receive and accommodate the toothed portion of the pinion gear, the bolt being slidably mounted in the door and configured to laterally slide between an unlocked orientation with the bolt being totally within the door and a locked orientation wherein the bolt extends from the door edge and engages the bolt receiving plate; and a handle plate having a flat rectilinear configuration with a fifth dimension sized to be accepted by and accommodated by and slidable within the rectilinear recess of the handle shaft of the internal lock housing, the handle plate having a protruding tooth, said tooth protruding toward and coaxial with the key receiving shaft of the external lock housing.

* * * * *